US010295259B1

(12) United States Patent
Sturgulewski

(10) Patent No.: US 10,295,259 B1
(45) Date of Patent: May 21, 2019

(54) CROSS AXIS VIBRATED CALCINER FOR THE HEATING OF GRANULAR MATERIAL

(71) Applicant: Raymond Matthew Sturgulewski, Pittsburgh, PA (US)

(72) Inventor: Raymond Matthew Sturgulewski, Pittsburgh, PA (US)

( * ) Notice: Subject to any disclaimer, the term of this patent is extended or adjusted under 35 U.S.C. 154(b) by 56 days.

(21) Appl. No.: 15/530,794

(22) Filed: Mar. 2, 2017

Related U.S. Application Data

(60) Provisional application No. 62/312,789, filed on Mar. 24, 2016.

(51) Int. Cl.

| | |
|---|---|
| ***F27B 9/24*** | (2006.01) |
| ***F27B 17/00*** | (2006.01) |
| ***F26B 3/22*** | (2006.01) |
| *F27B 7/14* | (2006.01) |
| *B01F 11/00* | (2006.01) |

(52) U.S. Cl.
CPC ..... *F27B 9/2453* (2013.01); *F26B 3/22* (2013.01); *F27B 17/00* (2013.01); *B01F 11/0005* (2013.01); *F27B 7/14* (2013.01)

(58) Field of Classification Search
CPC ..... F27B 9/2453; F27B 17/00; F26B 3/22
USPC ..... 432/11, 134
See application file for complete search history.

(56) References Cited

U.S. PATENT DOCUMENTS

| | | | | | |
|---|---|---|---|---|---|
| 2,019,912 | A * | 11/1935 | Sachs | F27B 17/00 | 432/137 |
| 2,026,441 | A | 12/1935 | Shaftner | | |
| 2,420,126 | A * | 5/1947 | Curll | F27B 9/2453 | 432/121 |
| 3,433,468 | A * | 3/1969 | Schoenlaub | F27B 1/02 | 219/388 |
| 3,827,159 | A * | 8/1974 | Venanzetti | B07B 1/12 | 165/120 |
| 3,922,043 | A | 11/1975 | Tompkins | | |
| 3,945,513 | A * | 3/1976 | Scheffler | F27B 9/22 | 198/766 |
| 4,211,121 | A | 7/1980 | Brown | | |
| 4,399,350 | A * | 8/1983 | Schneider | B01J 37/08 | 219/388 |
| 4,400,153 | A | 8/1983 | Miskell | | |
| 4,576,924 | A * | 3/1986 | Koch | B01J 8/16 | 198/770 |
| 4,974,334 | A * | 12/1990 | Roddewig | B01J 8/40 | 34/164 |
| 2015/0362182 | A1* | 12/2015 | Bertram | F23G 5/0276 | 432/11 |

* cited by examiner

*Primary Examiner* — Steven B McAllister
*Assistant Examiner* — Benjamin W Johnson
(74) *Attorney, Agent, or Firm* — Kinter IP, LLC; Mary Frances Ludwig

(57) ABSTRACT

A machine for the heating of granular material at high temperature, wherein a vessel is divided into compartments by vessel dams and vibrated in a direction perpendicular or 'Cross Axis' to the vessel longitudinal axis. The vessel is vibrated by counter rotating rotary vibrators to create a "Cross Axis" vibration causing a circular cascading movement of the granular material within the vessel. The vessel is surrounded by a furnace heated by electric power or a combustible gas.

7 Claims, 11 Drawing Sheets

CROSS AXIS VIBRATED CALCINER FOR THE HEATING OF GRANULAR MATERIAL

CROSS REFERENCE TO RELATED APPLICATIONS

This application claims the benefit of the provisional patent application Ser. No. 62/312,789, filed on Mar. 24, 2016.

FEDERALLY SPONSORED RESEARCH

Not applicable

SEQUENCE LISTING OR PROGRAM

Not applicable

The following is a tabulation of U.S. Patents of some prior art that presently appears relevant:

| Patent Number | Issue Date | Patentee |
|---|---|---|
| 3,922,043 | 1975 Nov. 25 | L. K. Tompkins |
| 4,400,153 | 1983 Aug. 23 | F. F. Miskell |
| 2,026,441 | 1935 Dec. 31 | R. R. Shaftner |
| 4,211,121 | 1980 Jul. 8 | W. R. Brown |

FIELD OF INVENTION

This invention relates to a method of heating of granular material at high temperature within a vessel which is vibrated by 'cross axis' vibration perpendicular to the long axis of the vessel to induce a circular motion of the granular material.

BACKGROUND OF PRIOR ART

The chemical and mineral industries use many processes to transform materials into other substances with desired properties for commercial marketing. Typical materials which require processing at high temperatures are those used for the making of catalysts such as Zeolites and aluminosilicates, Titanium Dioxide for pigments, ceramic compounds and rare earth minerals. Materials that are processed at lower temperatures for simple drying often use another process called 'plug flow' vibrating beds. Both are presented here as Prior Art.

1. Rotary Calciners—The traditional method of indirectly heating of granular solids is in rotary calciners. U.S. Pat. Nos. 1,995,948 and 2,026,441 disclose primary mechanisms of rotating a heated shell for this purpose. A rotary calciner shown in FIG. 1 is comprised of a cylindrical tube made of heat resistant alloy that is surrounded by a stationary furnace. Steel tires are fitted around the ends of the cylindrical tube which protrude from each end of the stationary furnace. The steel tires are supported by steel trunnion wheels. A ring gear surrounds one end of the cylindrical tube that is driven by a pinion gear which is mounted on a motor reducer causing the tube to slowly rotate.

The exterior of the cylindrical tube is indirectly heated by the furnace and granular material is fed in to the front of the cylindrical tube by a mechanical feeder. As the tube rotates, the granular material is tumbled in a circular cascading motion as shown in FIG. 2. As the granular material is heated, it slowly migrates to the end of the tube and discharges the cylindrical tube through a discharge breeching.

Key to the operation of the rotary calciner is the circular or 'cascading' motion of the granular material which continually exposes material to the radiant heat from the cylindrical tube heated by the furnace. Rotary calciners are also sloped slightly downward from the feed end to the discharge end to aid in the migration of the granular material from feed to discharge.

Typical operating temperatures of rotary calciners are between 800° F. and 2,000° F.

Common to all rotary calciners is the expensive mechanical hardware required only to rotate the shell. The steel tires are forged fabrications and require flame hardening to resist the high contact surface stresses. Also the steel trunnion rollers require flame or induction hardening. The large ring gears and pinion gears are custom made and expensive to manufacture. The cylindrical tube must be made of expensive heat resistant alloys. Supporting the cylindrical tube over the large span between the steel tires requires cylindrical tube to be very thick to withstand the stresses created having the cylindrical tube supported as a simple beam by the steel trunnion wheels outside the furnace.

The entire rotary calciner is usually sloped at a rise of ¼ inch to one foot to promote the migration of granular material from the feed to the discharge as the cylindrical tube is rotated.

2. Vibrating bed equipment—Other processes used by industry is for the transport, screening and thermal drying of granular material in vibrating beds. U.S. Pat. No. 3,922,430 disclose primary mechanisms of a motorized eccentric mass to induce vibration. As shown in FIG. 3 Prior Art, a vessel contains the granular material and is fed at one end through a feed chute. Attached to the vessel is a vibrator mount to which is attached two counter-rotating rotary vibrators. A rotary vibrator is comprised of a motor with eccentric weights fitted to each end of the motor. The entire device is mounted on vibration isolators which allow the vessel, vibrator mount, and rotary vibrators to freely vibrate while isolating the vibrations from the surroundings.

When two rotary vibrators are energized in opposite rotational direction of each other the inertial effect is to cause a counter rotation 180° of phase displacement of each other. This creates a linear path of vibration perpendicular to a line defined by the two centers of the rotary vibrators. The result is a repeated linear path of motion and force for each revolution as shown by arrow 21' in FIG. 4 Prior Art. The force required of the rotary vibrators to create the motion is generally three to four times the weight of the vibrating mass.

The repeated linear force is transmitted through the vessel and causes the granular material to be transported in a linear path parallel to the long axis of the vessel referred to as 'Plug Flow' motion. Retaining the granular material within the vessel is a vessel dam. During operation, the granular material fills to the top of the vessel dam until the vibrating forces cause the granular material to leap over the top of the vessel dam and discharge from the discharge chute.

Typical operating temperatures of vibrating dryers are between 160° F. and 650° F. Typical vibrating vessels depicted by FIG. 3 such as screens, dryers and conveyors are quite common in processing granular solids. These vessels orient the vibrations in the direction of solids transport known as 'Plug Flow' since the orientation of the vibration is aligned in the direction of material movement.

SUMMARY OF THE INVENTION

Objects and Advantages

The present invention achieves a cascading, circular motion of the granular material by vibrating a circular shaped vessel perpendicular to the vessel long axis or 'cross axis' as shown in FIG. 5 where the granular material flows along the bottom of the vessel and flows back down over the top surface of the mass.

FIG. 6 section shows the vibration induced motion principle of the invention which re-orients the direction of vibration in a 'Cross Axis' manner, as opposed to 'Plug Flow' and thus disassociates the axis of vibration with the axis and direction of material transport.

Material transport is of the present invention is accomplished by energizing two counter-rotating rotary vibrators perpendicular to the long axis of the vessel. The vessel and the rotary vibrators are mounted on a vibration isolated platform. The material transport is aided by a slight downward slope of 3 to 6° in the vibrating vessel. The granular material moves from one compartment to the next by flowing over each compartment vessel dam as the material migrates from the high end of the vessel to the low end of the vessel.

The circular shape of the vessel and vibrations of 2 to 3 mm amplitude at a frequency between 15 to 30 Hz induces energy into the granular material to induce mobility and flow along the bottom circular surface of the vessel until it crests at the top where the granular material now cascades down over the top surface of the bed and the material repeats the path. The vessel dam, being a metal plate, is located within the granular material bed. The vessel bed holds a volume equal to 10% to 15% of the full circle area as is common practice with the Prior Art. The top edge angle of the dam corresponds to the dynamic angle of repose of the granular material. This is different for each granular material based on its properties, but generally occurs between 20 and 40 degrees. The lower top edge of the dam is elevated to prevent granular material in the lower bed from prematurely crossing over to the next compartment.

Since the same cascading material motion is achieved without rotating the vessel, the costly mechanical components required for rotary calciners such as ring and pinion gears, gear motor reducers, forged steel tires, trunnion rollers and other mechanical equipment are not needed and therefore eliminated. Further, since the vessel does not rotate, it eliminates the need for the circular tube common to the Prior Art. The circular tube is replaced by a fabricated vessel. Since the vessel vibrates rather than rotates, it permits the vessel to be supported by legs equally spaced along the vessel length that pass through the furnace body requiring small openings in the furnace around the legs to permit the small vibration. Since multiple legs support the vessel, the supported vessel segment length is reduced compared to Prior Art calciners. This lowers the bending stress on the heated vessel. Lower bending stresses permit a thinner vessel wall of expensive alloy weight, further reducing the cost of the machine.

Costs are further saved due to the reduced spare parts required for maintenance since many of the mechanical components required for Prior Art rotary calciners have been eliminated. Since fewer mechanical parts are required, the machine reliability increases.

While I prefer that the vessel is shaped as a circular segment, other shapes may be sufficient. The vessel is fabricated of heat resistant metal alloy plate or other heat resistant materials such as ceramics or quartz.

Within the vessel are vessel dams which create equal volume compartments that are sequentially filled by the granular material filling the first compartment and overflowing the vessel dam to the next until the entire vessel is filled. The vessel dams are necessary to maintain an even filling of each compartment. Without the vessel dams, the granular material favors heavier loading of one end of the vessel or the other based on the properties of the granular material.

The entire machine is fitted to a structural steel base shown in FIG. 7. At the discharge end of the base is a pivot block while at the feed end a lifting jack is attached to the base. The lifting jack raises the entire machine to cause the slight slope which is needed for granular material transport down the vessel length. Granular materials are fed at the high end of the vessel and the vibrations create the circulating motion as the first compartment fills. Once the level of the circulating granular material reaches the top of the vessel dam the granular material overflows to the next compartment. This continues until all compartments are filed and the granular material exits the vessel by flowing out of a discharge opening in the vessel end plate and into the discharge chute.

The rotary vibrators are energized before beginning to fill the vessel. While the vessel is filling, the granular material flows into the first compartment and flows down through a vessel drain opening at the vessel bottom near the dam, through a gravity drain port and into a drain trough. The granular material cannot flow upwards from the drain trough through the gravity drain ports due to its design of staggered horizontal shelves in the gravity drain port. The granular material fills the drain trough and remains stagnant. The compartments continue filling by the granular material flowing over the vessel dam into the remaining compartments. As this occurs granular material flows into each compartment's gravity drain port and on into the drain trough. The vessel is also fitted with a cover.

The vessel is heated by an electric or natural gas furnace supplying the heat to the granular material through the metal vessel.

The present invention includes the following design features.

Vessel Expansion Slide

The vessel metal alloy will expand when heated according to the alloys property of thermal expansion. There is provided vessel expansion slides attached to the bottom of the vessel supporting legs which permit the expansion of the vessel but still securing the vessel legs to the horizontal platform. The assembly is comprised of a ball joint swivel bearing that has been modified with a saw cut radially from the outer edge of the ball joint swivel bearing through to its inside radius as shown in FIGS. 12 and 13.

A shaft passes through the ball joint swivel bearing while the outer diameter is encompassed by the swivel bearing housing fitted with a slot and a compression bolt. The bolt is tightened upon the swivel bearing housing squeezing tightly upon the shaft that passes through the ball joint swivel bearing. The provision of the ball joint swivel bearing permits three degrees of freedom (pitch, roll and yaw) to provide ease of alignment of the final assembly. The shaft in the ball joint swivel bearing passes through linear bearings on either side of the vessel leg which provides the element of linear expansion and yet allows the forces of vibration to be sufficiently transmitted to the vessel through the horizontal platform.

Vessel Dam Shape

During the process of invention, a shape of the vessel dam was developed to include a top inclined edge equal to the dynamic angle of repose of the granular material. The bottom edge of the vessel dam is welded to the circular arc inside of the vessel. The transport of granular material from one compartment to the next is achieved by material flowing over the top of the dam. The motion of the granular material, at times, generates a small zone of turbulence at the lower surface of the material in motion. This may cause the granular material to prematurely splash over to the adjacent compartment. Therefore a raised section of the vessel dam was included to more adequately contain the granular material in this region as shown in FIG. 11*a*.

Further development of the vessel dam design provides an alternative vessel dam design that is a full profile plate of the vessel that has openings in the alternative vessel dam near the desired fill boundary as shown in FIG. 11*b*. The advantage this affords is that the alternative vessel dam can be welded to the vessel cover making a much stronger welded assembly. The disadvantage is that the full profile alternative vessel dam interrupts the visibility down the length of the vessel when viewed from the feed end. The option of using the alternative vessel dam would be at the discretion of the operator regarding the value they may perceive of having a clear line of sight of the granular material in motion during operation.

Vessel Drain Feature

The shape of the vessel and the plurality of vessel dams create compartments within the vessel. The invention includes a means to drain the vessel of granular material for the purpose of equipment maintenance. This is done with compartment drain openings, gravity drain ports, material drain trough, drain spout and a drain spout closure valve as shown in FIG. 14.

Each compartment is fitted with a drain opening at the base of the compartment near the vessel dam. Beneath each drain opening is a gravity drain port which is a small box with four vertical sides and has two horizontal staggered shelves within the box as shown in FIGS. 15 and 16. The particular shape of the gravity drain port permits granular material to flow down the staggered shelves and into the drain trough where there are contained by the drain spout closure valve until the drain spout closure valve is opened, releasing the granular material in the drain trough and emptying the compartments. The purpose of the gravity drain ports is to prevent the upflow of material from the drain trough upwards into the downstream compartments through the remaining drain openings.

FIGS. 17, 18A and 18B show the vessel under normal operating conditions where the granular material flows over each vessel dam and is discharged through the discharge chute.

FIGS. 19, 20A and 20B show the vessel during the vessel draining operation. The vessel continues to vibrate but the feed of granular material to the machine is turned off. The drain closure valve is opened allowing the granular material to flow out of the drain spout and begins the emptying of the drain trough and the vessel compartments of granular material.

Draining only occurs when the drain spout closure valve is opened and the granular material is released from the drain trough. As the drain trough empties the granular material flows down from each compartment through the drain openings and through the gravity drain ports completely draining the vessel of all granular material.

Varying Vessel Cross Section Areas

Further development of the present invention is the ability to configure a vessel of varying cross section areas as shown in FIG. 21. This is not possible with the Prior Art of rotary calciners due to the requirement for a consistent diameter of the cylindrical tube. The ability to vary the area along the length of the vessel may be advantageous in the processing of heat sensitive materials or materials with a high level of chemically bound water. As the vessel areas change from a larger area shown in FIG. 22 to a smaller area shown in FIG. 23 the effect of retention time and exposed heat transfer surface area will change as may be required by the process. This area change is achieved by aligning the top of the vessel dams to a common level by the addition of a vessel transition dam.

LIST OF PARTS

| No. | Part Description |
|---|---|
| 1 | Rotary calciner |
| 2 | Cylindrical tube |
| 3 | Steel tire |
| 4 | Steel trunnion wheel |
| 5 | Ring gear |
| 6 | Pinion gear |
| 7 | Motor reducer |
| 8 | Furnace |
| 9 | Gas burner |
| 10 | Feeder |
| 11 | Discharge breeching |
| 12 | Granular material |
| 13 | Vessel |
| 14 | Feed chute |
| 15 | Vessel dam |
| 16 | Discharge chute |
| 17 | Vibration isolator |
| 18 | Vibrator mount |
| 19 | Motor |
| 20 | Eccentric weight |
| 21 | Rotary vibrator |
| 22 | Furnace top half |
| 23 | Furnace bottom |
| 24 | Right support leg |
| 25 | Left support leg |
| 26 | Vessel cover |
| 27 | Platform |
| 28 | Furnace leg brush seal |
| 29 | Vessel expansion slide |
| 30 | Furnace support brace |
| 31 | Isolator column |
| 32 | Structural base |
| 33 | Lifting jack |
| 34 | Pivot block |
| 35 | Furnace hinge |
| 36 | Vessel front plate |
| 37 | Vessel front plate opening |
| 38 | Feed brush seal |
| 39 | Discharge brush seal |
| 40 | Split ball joint swivel bearing |
| 41 | Swivel bearing housing |
| 42 | Housing bolt |
| 43 | Shaft |
| 44 | Spacer block |
| 45 | Linear bearing |
| 46 | Vessel end plate |
| 47 | End plate opening |
| 48 | Drain trough |
| 49 | Drain opening |
| 50 | Gravity drain port |
| 51 | Drain spout |
| 52 | Drain spout closure valve |
| 53 | Alternate vessel dam |
| 54 | Alternate vessel dam openings |
| 55 | Vessel transition dam |
| 56 | Reduced area vessel |
| 57 | Reduced area vessel dam |

DETAILED DESCRIPTION OF PRIOR ART

Figure 1:
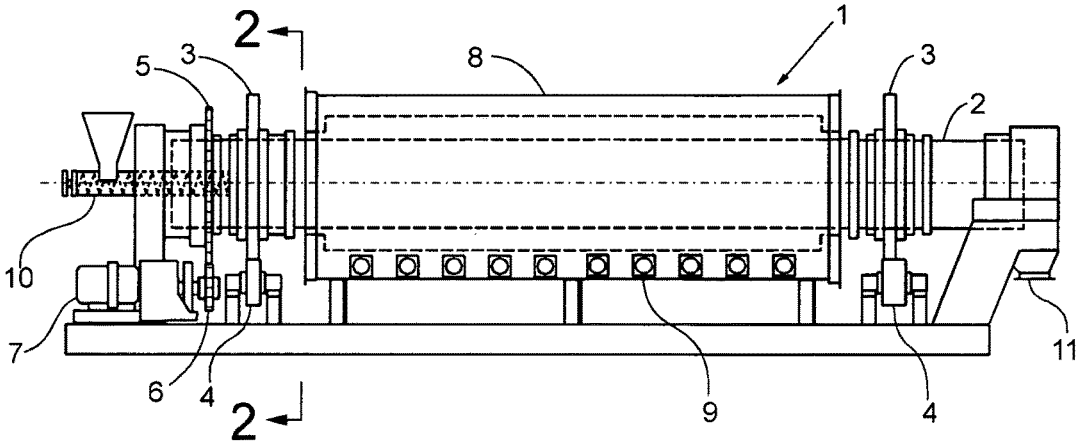
FIG. 1 Prior Art
FIG. 1 Prior Art, is a side elevation diagram of a conventional rotary calciner.
Figure 2:
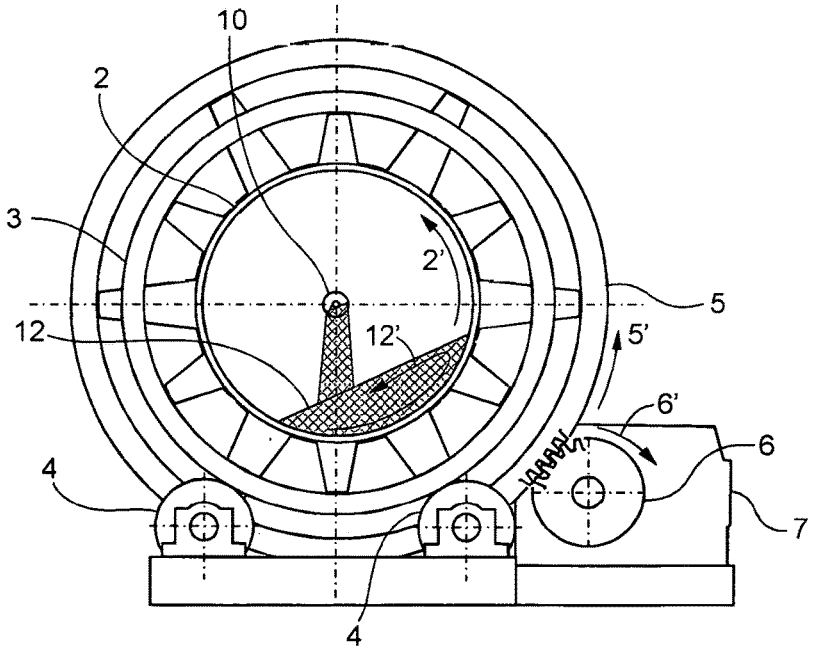
FIG. 2 Prior Art
FIG. 2 Prior Art, is a cross section diagram of a conventional rotary calciner.

Referring to FIGS. 1 and 2 both Prior Art as it relates to the method of operation and the mechanical embodiments of conventional rotary calciners.

The Prior Art consists of a rotary calciner 1 comprised of a cylindrical tube 2 supported by steel tires 3 and rests on steel trunnion rollers 4. A ring gear 5 is circumferentially attached to the cylindrical tube 2 and is meshed with a pinion gear 6. The pinion gear 6 is driven by a motor reducer 7 causing the rotation of the cylindrical tube 2. Surrounding the cylindrical tube 2 is a furnace 8 which can be electrically heated or by the combustion of a gaseous fuel through a gas burner 9. Granular material 12 is fed to the rotary calciner by a feeder 10 and leaves the calciner through discharge breeching 11.

Referring to FIG. 2 Prior Art shows a section view of the Prior Art calciner with the granular material 12 tumbling in a cascading motion. The granular material 12 migrates down the cylindrical tube 2 being heated by radiation heat transfer to achieve the desired material properties.

Figure 3:
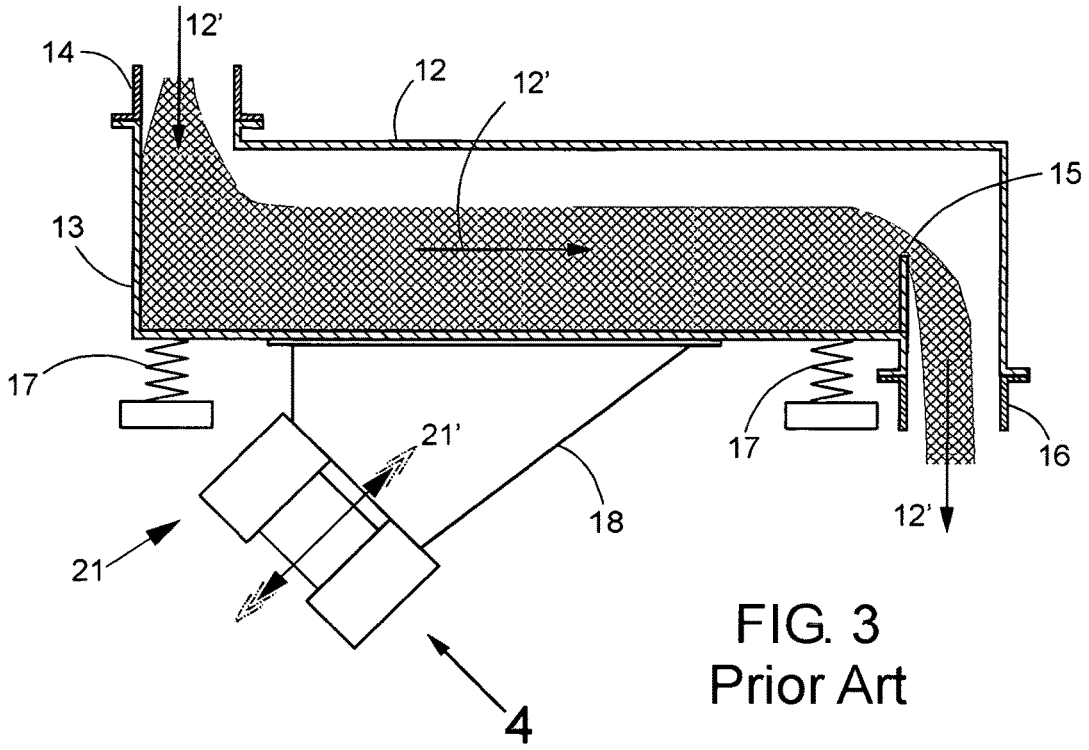
FIG. 3 Prior Art
FIG. 3 Prior Art, is a side elevation diagram of a conventional vibrating vessel describing plug flow motion.

Referring to FIG. 3 Prior Art, it shows the method of operation for conventional vibrating equipment and their dependency on the material transport phenomena known as 'plug flow' and shows an elevation view of a conventional 'Plug Flow' vibrating bed. A vessel 13 with a feed chute 14, a discharge chute 16 and a vessel dam 15 to maintain a level bed of granular material 12. Two counter rotating rotary vibrators 21 mounted on a vibrator mount 18 provide a linear path of vibration parallel to the long axis of the vessel 13. The assembly is supported by a plurality of vibration isolators 17. The orientation of the vibrators 21 creates vibration along the long axis of the vessel and imparts energy into the granular material 12 to cause the 'Plug Flow' motion of the granular material 12 from the feed to the vessel dam 15. The granular material 12 flows over the vessel dam 15 and into the discharge chute 16.

Figure 4:
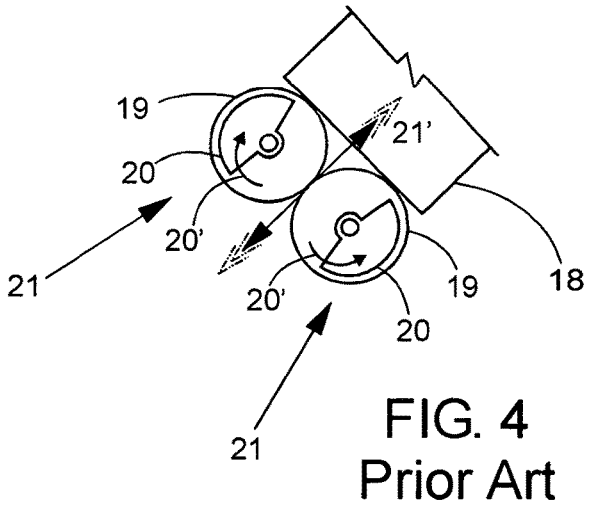
FIG. 4 Prior Art
FIG. 4 is a section view showing the counter rotation of two rotary vibrators and the resulting linear motion.

Referring to FIG. 4 Prior Art which shows a vibrator mount 18 supporting two counter rotating rotary vibrators 21. The two rotary vibrators 21 each having a motor 19 to which eccentric weights 20 are attached to each end of the motor 19. The motors 19 are rotated in opposite directions of each other one being clockwise and the other counter clockwise.

DETAILED DESCRIPTION OF THE INVENTION

Figure 5:
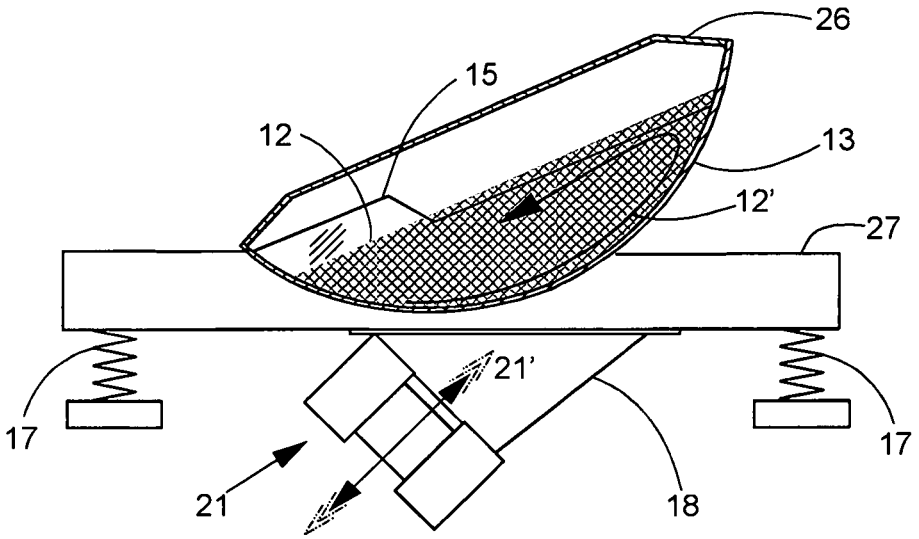
FIG. 5 shows a section view of vibration induced motion principle of the invention which reorients the direction of vibration in a 'Cross Flow' manner demonstrating the cascading material motion path.

Referring to FIG. 5, which demonstrates the "Cross Axis" vibration principle of the present invention, the circular shaped vessel 13 and vessel cover 26 are supported by platform 27. Vibrator mounts 18 connected to platform 27 support two rotary vibrators 21 (refer to FIG. 6). The two rotary vibrators 21 are rotated in opposite directions of each other, one being clockwise and the other counter-clockwise. The entire vibrating assembly is mounted on a plurality of vibration isolators 17.

Figure 6:
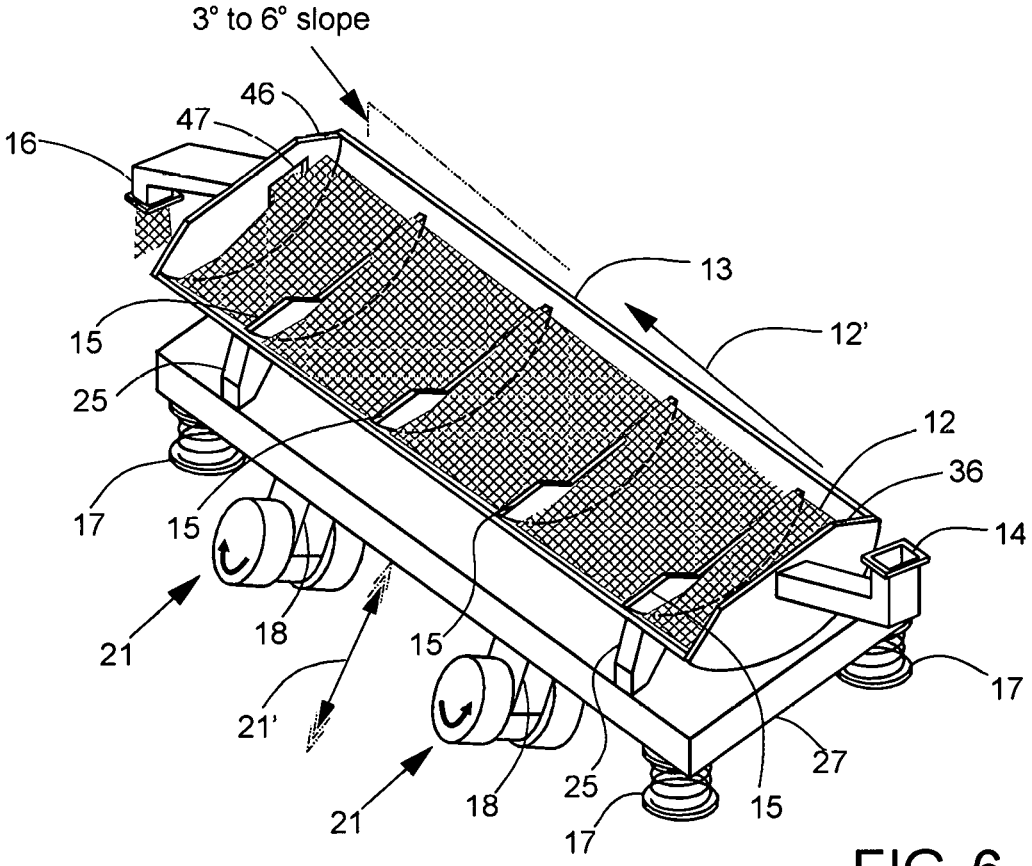
FIG. 6 is a perspective view of the primary elements of the present invention.

FIG. 6 shows a perspective view of an embodiment of a 'Cross Axis' vibrating bed. A vessel 13 with a vessel front plate 36, a vessel end plate 46, an end plate opening 47, a feed chute 14, a discharge chute 16 and a plurality of vessel dams 15 is configured to contain a bed of granular material 12. The vessel 13 is supported by a plurality of vessel legs 25 attached to the platform 27. Two counter rotating rotary vibrators 21 are mounted on a vibrator mount 18 attached to the platform 27 and provide a linear path of vibration perpendicular, or 'Cross Axis' to the long axis of the vessel 13. The vessel 13 is slightly sloped from the feed to the discharge to aid in transport of the granular material. The assembly is supported by a plurality of vibration isolators 17.

Figure 7:
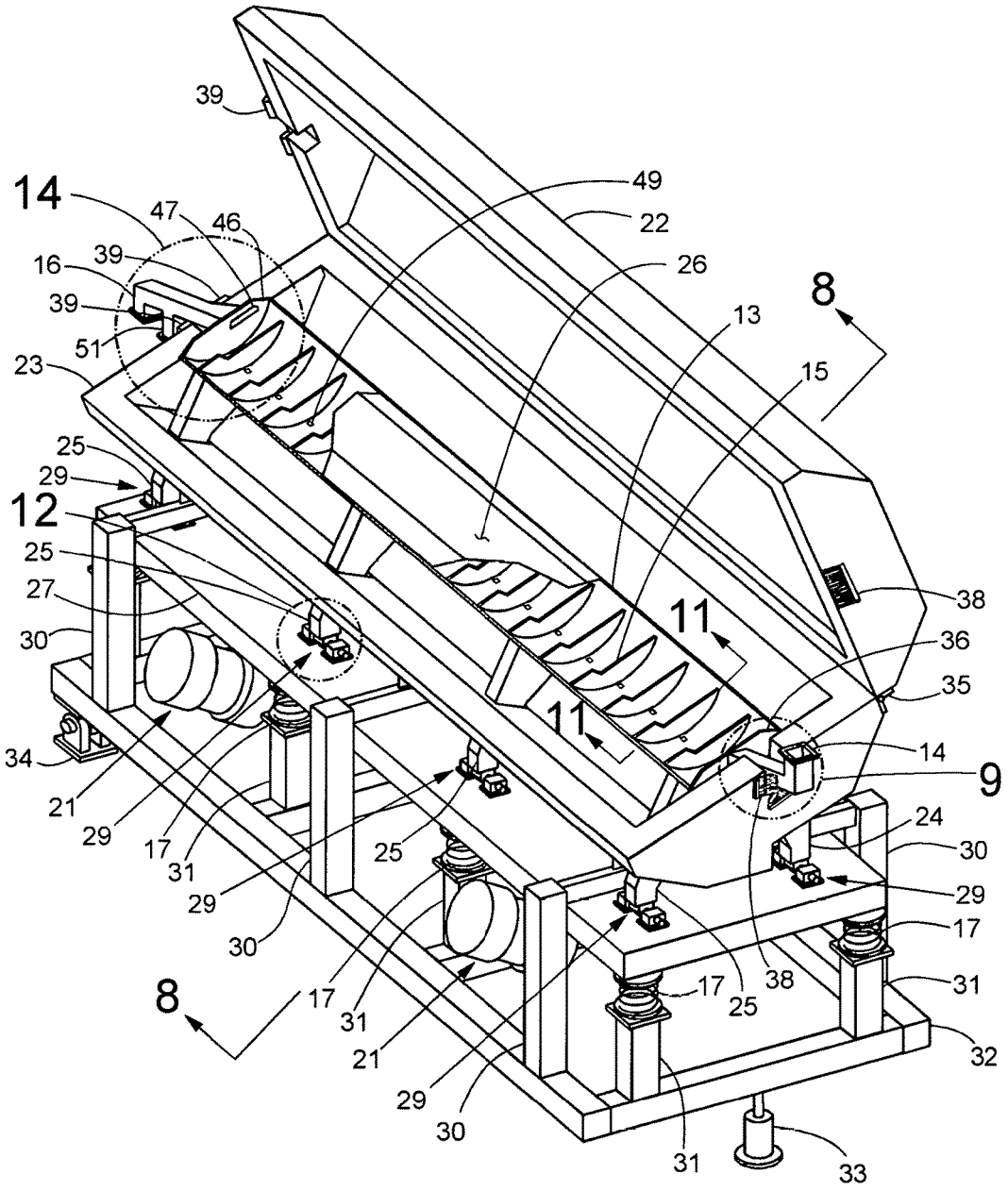
FIG. 7 is a perspective view of the present invention showing the inventions commercial features.

FIG. 7 is a perspective view of the commercial features of the present invention and shows a vessel 13 fabricated from heat resistant material which is supported by a plurality of support legs 24 and 25 along the vessel 13 length. Within the vessel 13 are located a plurality of vessel dams 15 which are spaced a distance equal to the effective radius of the vessel 13. The vessel 13 contains and transports granular material 12. The vessel 13 is covered with a vessel cover 26.

The front of the vessel 13 is closed by the vessel front plate 36 to which is mounted the feed chute 14. The opposite end of the vessel 13 is closed off by the vessel end plate 46 which includes the vessel end plate opening 47 through which the granular material discharges to the discharge chute 16. Located behind and beneath the discharge chute 16 is the drain spout 51 which is part of the vessel drain design feature. Attached to the furnace bottom half 23 and the furnace top half 22 is the discharge brush seal 39 to reduce radiant heat losses.

Figure 12:
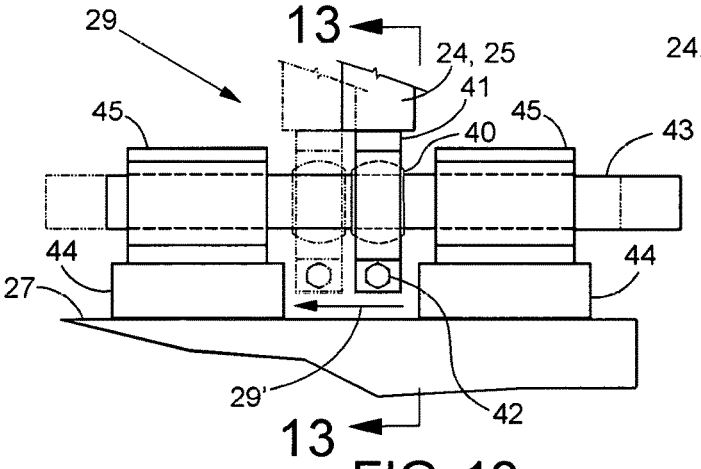
FIG. 12 is a side elevation view taken from FIG. 7 showing the vessel expansion slide 29.

The vessel 13 and the support legs 24 and 25 are connected to a horizontal platform 27 through vessel expansion slides 29 which are further described in FIG. 12. Two counter-rotating rotary vibrators 21 are mounted to the underside of the horizontal platform 27 attached at an angle between 45 and 60 degrees from the horizontal, determined by test work examining the granular material motion properties.

The horizontal platform 27 is supported by a plurality of vibration isolators 17. The vibration isolators 17 are supported on isolator columns 31 attached to the structural base 32.

An electrically heated or natural gas fired furnace constructed as furnace top half 22 and the furnace bottom half 23 surround the vibrating vessel 13 for the purpose of providing the required heat to the vessel 13. The furnace hinge 35 allows the furnace top half 22 to be lifted to the raised position for maintenance. The weight of the furnace is supported by the furnace support brace 30 which connects with the structural base 32. The support legs 24 and 25 of the vessel 13 pass through openings in the furnace bottom half 23. The support legs 24 and 25 of the vessel 13 are attached to vessel expansion slides 29 to allow for the linear expansion of the vessel during heating.

Drain openings 49 allow the draining of the granular material from the vessel 13 and is explained in more detail in FIG. 14 through FIG. 20.

The entire machine is supported at the discharge end of the structural base 32 by a pivot block 34. A lifting jack 33 supporting the feed end is located at the front end of the structural base 32 and used to impart an adjustable downward slope of 3° to 6° from the feed end to the discharge end to aid in material movement.

Figure 8:
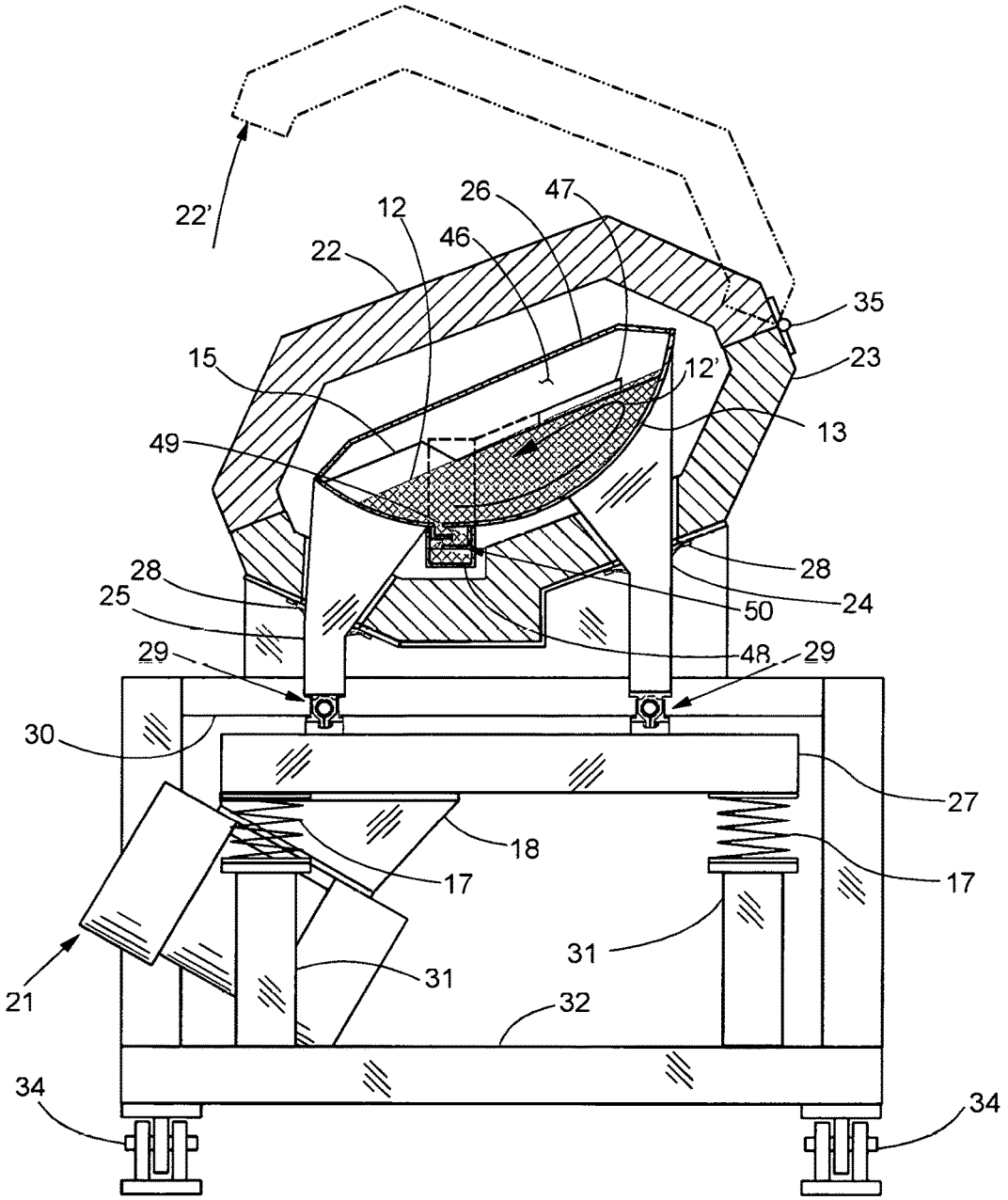
FIG. 8 is a section view cut from FIG. 7 of the present invention.

FIG. 8 shows a section view taken from FIG. 7 showing vessel 13 with granular material 12, vessel dam 15, vessel cover 26, right support leg 24, left support leg 25, horizontal platform 27, rotary vibrators 21, and the vibrator mount 18 with a plurality of vibration isolators 17. The vibration isolators 17 are supported by isolator columns 31 which are attached to the structural base 32. The support legs 24 and 25 are attached to the vibrating platform 27 by a vessel expansion slide 29. The leg brush seals 28 reduce radiant heat losses from the furnace bottom half 23 where the right support leg 24 and the left support leg 25 pass through openings in the furnace bottom half 23.

The furnace top half 22 and furnace bottom half 23 are connected by the furnace hinge 35. The furnace bottom half 23 is supported by furnace support brace 30 which is connected to the structural base 32. The structural base 32 is fixed to a foundation through a pivot block 34 mounted near the discharge end of the invention.

A vessel end plate 46 with the vessel end plate opening 47 allows the granular material 12 to exit from the vessel 13.

At the bottom of vessel 13 is located the drain openings 49 that occur near each vessel dam 15. Granular material 12 flows through the drain openings 49 into the gravity drain ports 50 and into the drain trough 48 as part of the method to drain the vessel 13 of all granular material 12 for maintenance.

Figure 9:
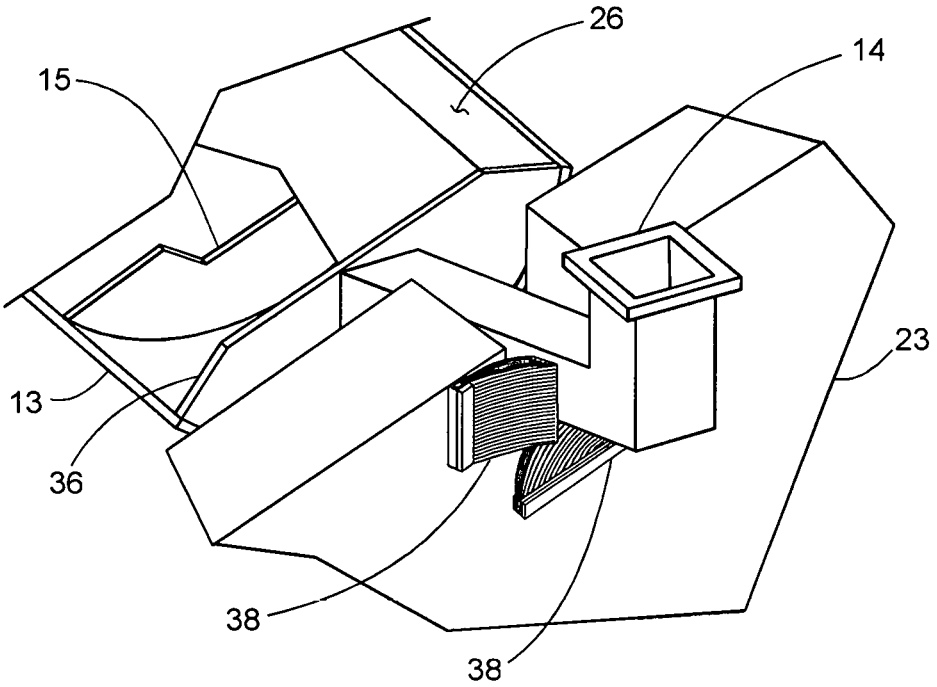
FIG. 9 is a perspective view taken from FIG. 7, showing the feed end and the wire brush seal to enclose the feed furnace opening of the furnace housing.

FIG. 9 shows a perspective of the feed zone of vessel 13 showing the vessel dam 15 and feed chute 14 as it passes through the front of the furnace bottom half 23. The feed chute 14 is attached to the vessel front plate 36. Attached to the furnace bottom half 23 and the furnace top half 22 are feed brush seals 38 which minimize radiation heat losses.

Figure 10:
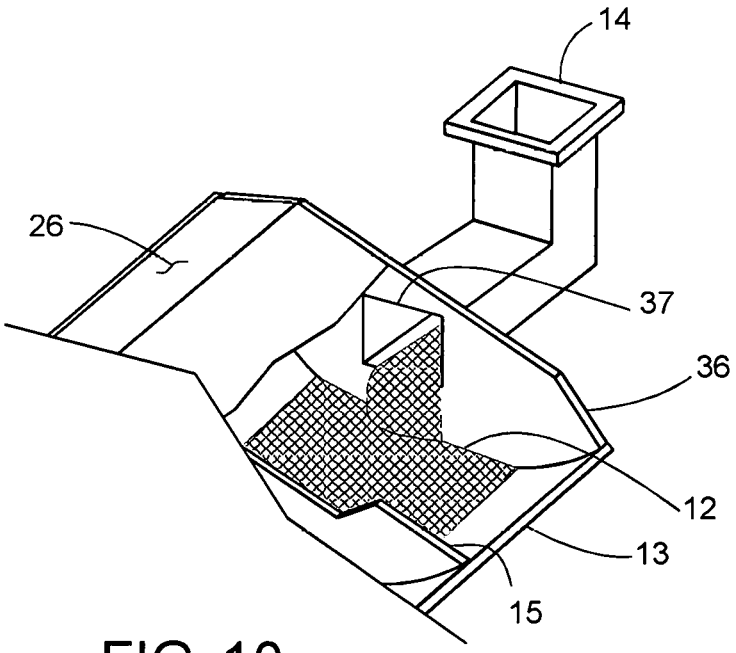
FIG. 10 is a reverse perspective view of FIG. 9 showing the vessel front plate and the front plate opening.

FIG. 10 shows a reverse view of the vessel 13 of FIG. 9, including vessel dam 15, vessel cover 26, vessel front plate 36, and the vessel front plate opening 37, which permits the flow of granular material 12 from the feed chute 14 and into the vessel 13.

Figure 11A:
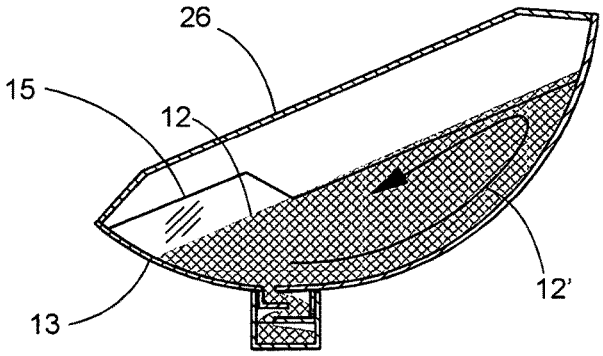
FIG. 11A is a section view of the vessel dam in relation to the vessel and the drain trough.

FIG. 11*a* shows a cross section of the preferred profile of the vessel 13 and the vessel dam 15 attached to the vessel 13. The lower region of the dam embodies a raised edge so as to prevent granular material 12 from spilling over the lower region edge.

Figure 11B:
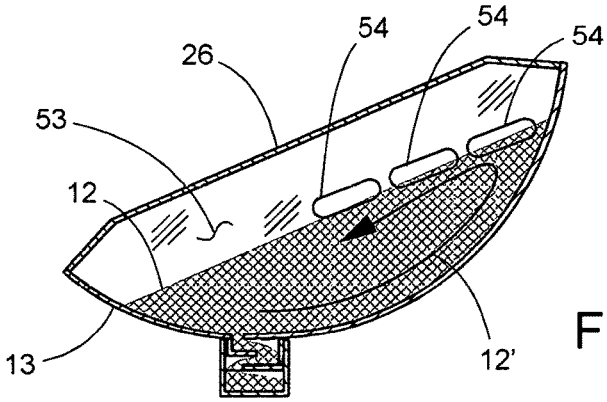
FIG. 11B is a section view of an alternative design vessel dam in relation to the vessel and the drain trough.

FIG. 11*b* shows a cross section of the preferred profile of the vessel 13 with an alternative vessel dam 53 that embodies a full profile plate and provides alternative vessel dam openings 54 located at the desired material discharge level which permits the granular material 12 to escape to the next compartment. The provision of a full profile plate permits the welding of the top of the dam 15 to the vessel cover 26 providing a stronger assembly, although, at the sacrifice of visibility down the length of the vessel 13.

FIG. 12 shows an elevation view of the vessel expansion slide 29 attached to support legs 24 and 25 which is attached to the swivel bearing housing 41. Within the swivel bearing housing 41 is positioned a split ball joint swivel bearing 40. The swivel bearing housing 41 is separated at the bottom by a flanged slot through which a housing bolt 42 passes. The swivel bearing housing 41, when squeezed by housing bolt 42, compresses the split ball joint swivel bearing 40 upon the shaft 43 which passes through the swivel bearing housing 41, fixing it firmly onto shaft 43. This assembly provides three degrees of freedom about the shaft 43 providing alignment flexibility during the assembly of the vessel expansion slide 29. Each end of the shaft 43 pass through linear bearings 45 allowing the vessel 13 and support legs 24 and 25 to move in a horizontal linear direction along the length of the horizontal platform 27 as the vessel 13 length increases due to the vessel 13 linear expansion caused by heating.

Figure 13:
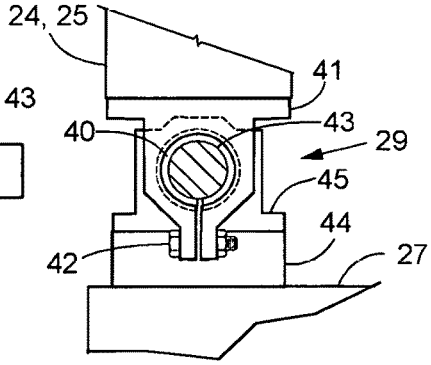
FIG. 13 is a section view taken from FIG. 12 showing the interior details of the vessel expansion slide 29.

Referring to FIG. 13, a section view of the vessel expansion slide 29 is shown, including swivel bearing housing 41, housing bolt 42, and shaft 43. A spacer block 44 is located beneath each linear bearing 45 to provide adequate clearance between the swivel bearing housing 41 and the horizontal platform 27.

Figure 14:
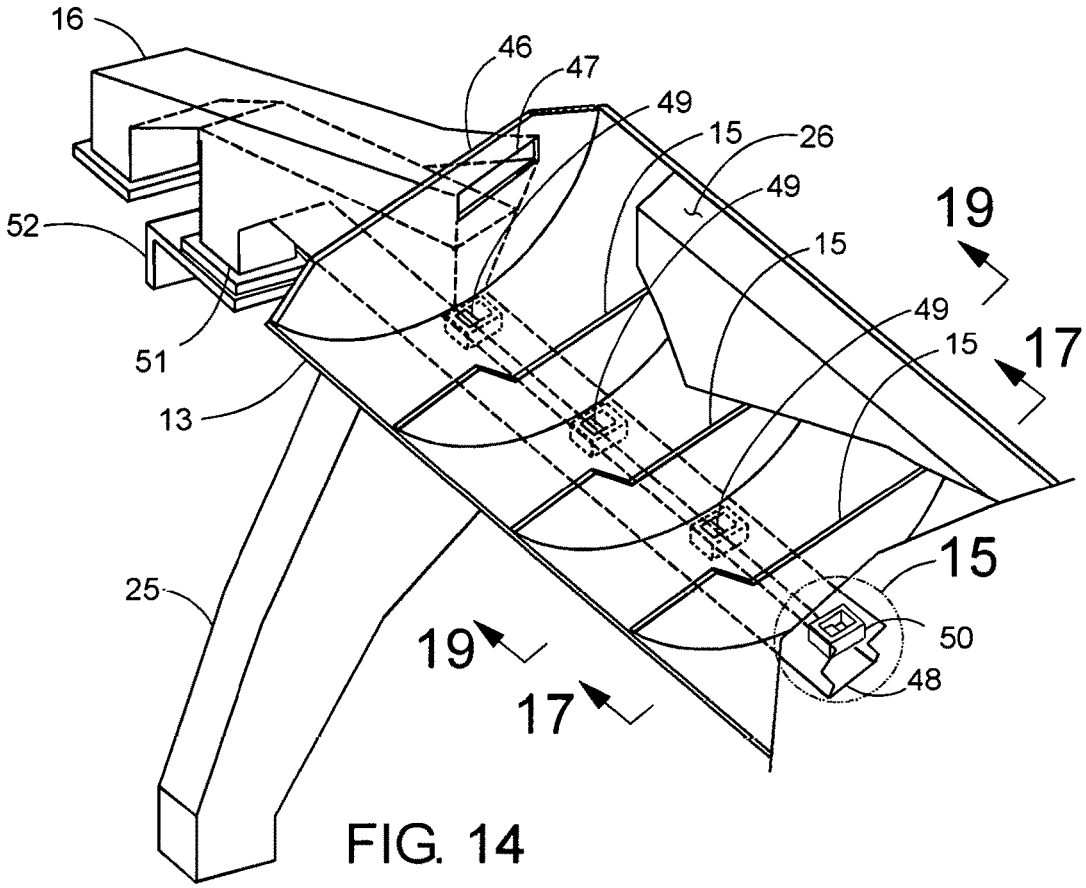
FIG. 14 is an enlarged perspective view of the discharge end taken from FIG. 7 showing details of the vessel discharge and the vessel drain method.

FIG. 14 is a perspective view showing the vessel end plate 46 and the end plate opening 47, which is the material passage for discharge chute 16. Also shown are a plurality of drain openings 49 located at the bottom of the vessel 13 near each vessel dam 15. Below each drain opening 49 is a gravity drain port 50 which is attached to the underside of vessel 13 and oriented so the drain opening 49 is a passage through which granular material can flow through the gravity drain port 50 into the drain trough 48 and to the drain spout 51. Drain spout 51 may be closed by the drain spout closure valve 52.

Figure 15:
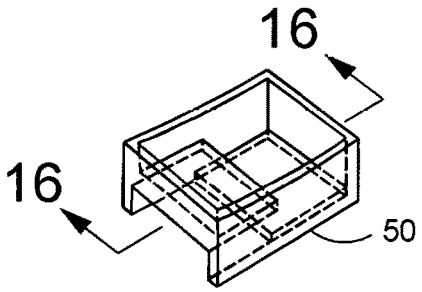
FIG. 15 is a perspective view taken from FIG. 14 showing an enlarged perspective view of the gravity drain port 50.

FIG. 15 shows an enlarged perspective view of the gravity drain port 50. The gravity drain port 50 is comprised of four vertical sides and two horizontal opposed shelves. Granular material 12 can flow down though the staggered horizontal shelves by the vibration, but is not able to flow upwards through the shelves due to the presence of the two horizontal opposed shelves in the gravity drain port 50.

Figure 16:
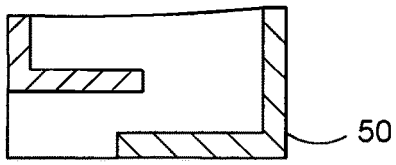
FIG. 16 is a section view taken from FIG. 15 showing a section view of the gravity drain port 50.

FIG. 16 shows a section view of the gravity drain port 50, clearly revealing the opposed horizontal shelves.

Figure 17:
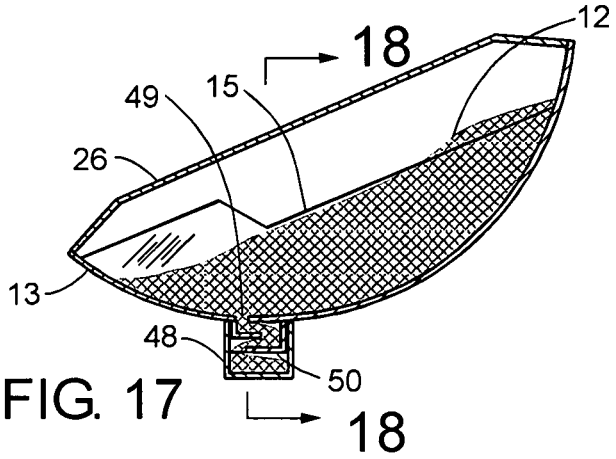
FIG. 17 is a section view taken of FIG. 14 of the preferred vessel during the normal operation of the invention showing a full bed of granular material.

FIG. 17 is a cross-sectional view along line 17-17 of FIG. 14 and shows the preferred profile of vessel 13, vessel cover 26, vessel dam 15, drain opening 49, gravity drain port 50, and the drain trough 48 during normal operation with a full bed of granular material 12.

Figure 18A:
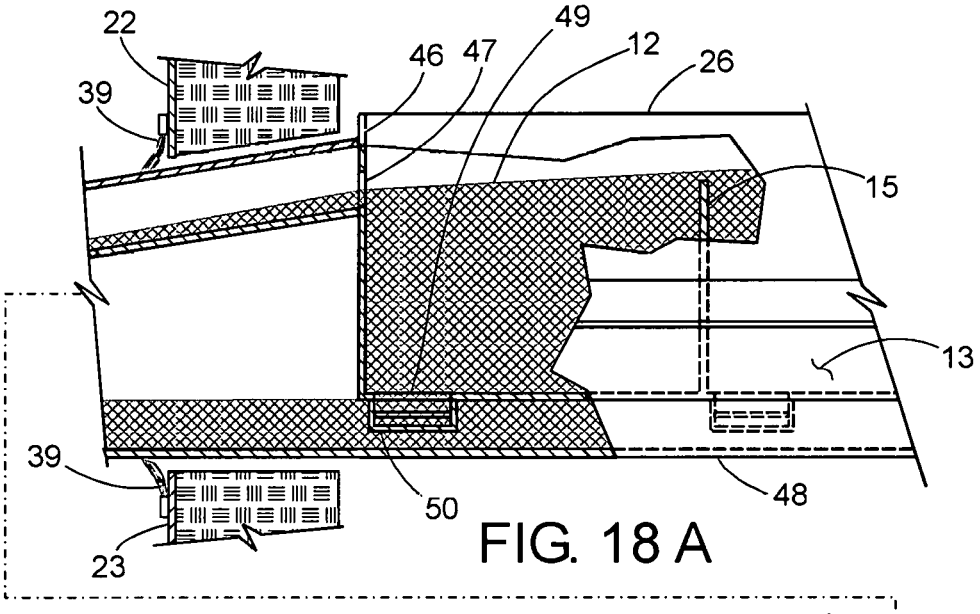
FIGS. 18A and 18B is a section view taken from FIG. 17 showing the vessel and the relationship to the vessel drain trough 48 the drain spout 51 and the discharge chute 16.
Figure 18B:
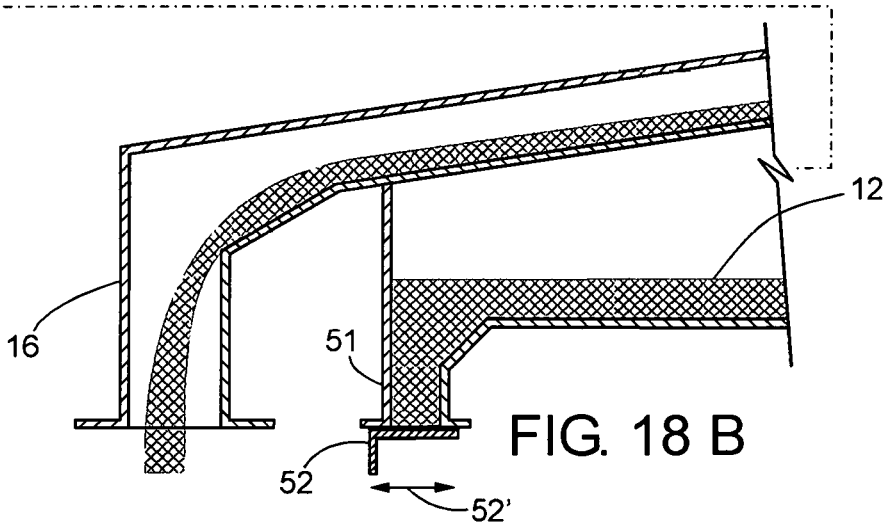

FIGS. 18A and 18B are sectional views along line 18-18 of of FIG. 17 showing the vessel 13, vessel dam 15, vessel cover 26, vessel end plate 46, vessel end plate opening 47, discharge chute 16, drain trough 48, drain opening 49, gravity drain port 50, drain spout 51, and the drain spout closure valve 52. The view is shown in the primary operation of the vessel 13 processing granular material 12 as flowing over the plurality of vessel dam 15 and flowing through the end plate opening 47 and out the discharge chute 16. Granular material 12 is trapped inside the drain trough 48 since the drain spout closure valve 52 is in the closed position. Also shown is discharge brush seal 39, attached to the furnace top half 22 and the furnace bottom half 23, which reduces radiation heat loss.

Figure 19:
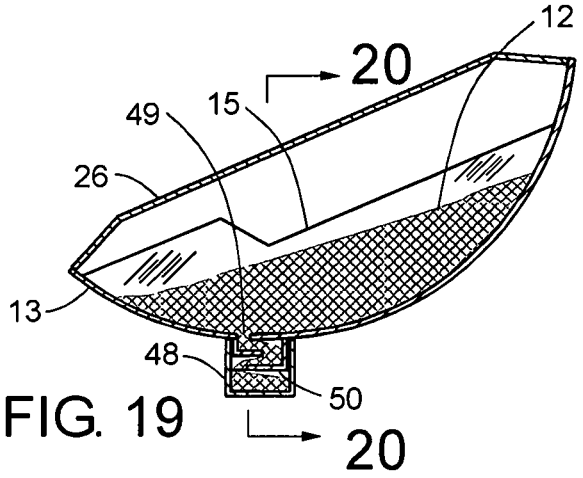
FIG. 19 is a section view of the preferred vessel 13 showing a decreased level bed of material in the process of being drained from the vessel.

FIG. 19 is cross section along line 19-19 of FIG. 14 showing the operation of draining the vessel 13. Shown are vessel dam 15, vessel cover 26, drain opening 49, gravity drain port 50, and the drain trough 48, as well as a reduced level of granular material 12.

Figure 20A:
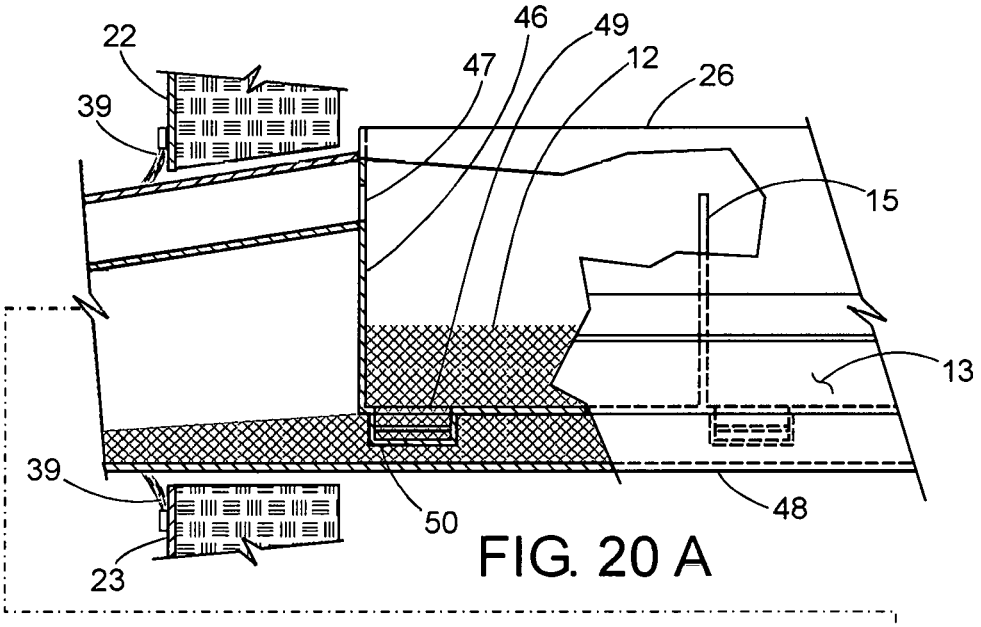
FIGS. 20A and 20B is a view taken from FIG. 19 showing a section view of the vessel.
Figure 20B:
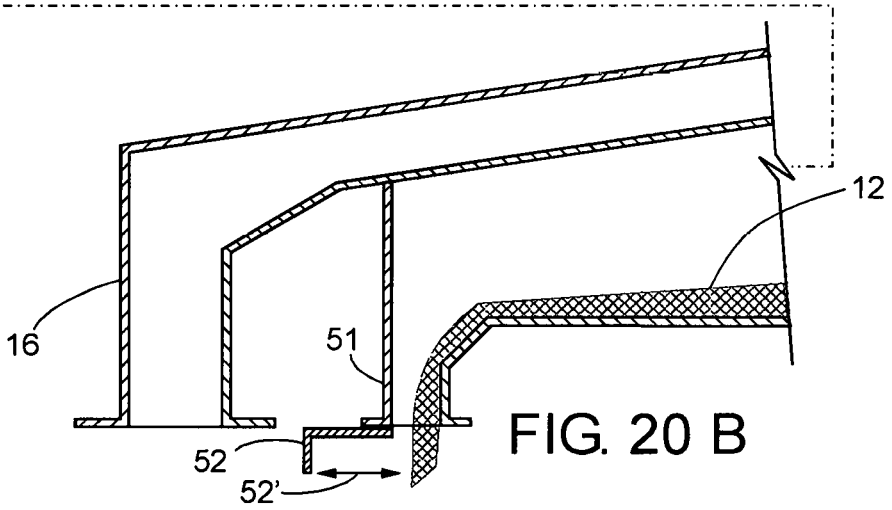

FIGS. 20A and 20B are sectional views along line 20-20 of FIG. 19, showing the draining of granular material 12 from the vessel 13. The shown level and volume of granular material 12 are lower than as shown in FIGS. 18A & 18B due to the draining. Also shown are the vessel 13, vessel cover 26, vessel dam 15, vessel end plate 46, vessel end plate opening 47, discharge chute 16, drain trough 48, drain opening 49, gravity drain port 50, and drain spout 51. Drain spout closure valve 52 is shown in the opened position allowing granular material 12 to flow from the drain trough 48 through the drain spout 51, which empties the granular material 12 from vessel 13.

Figure 21:
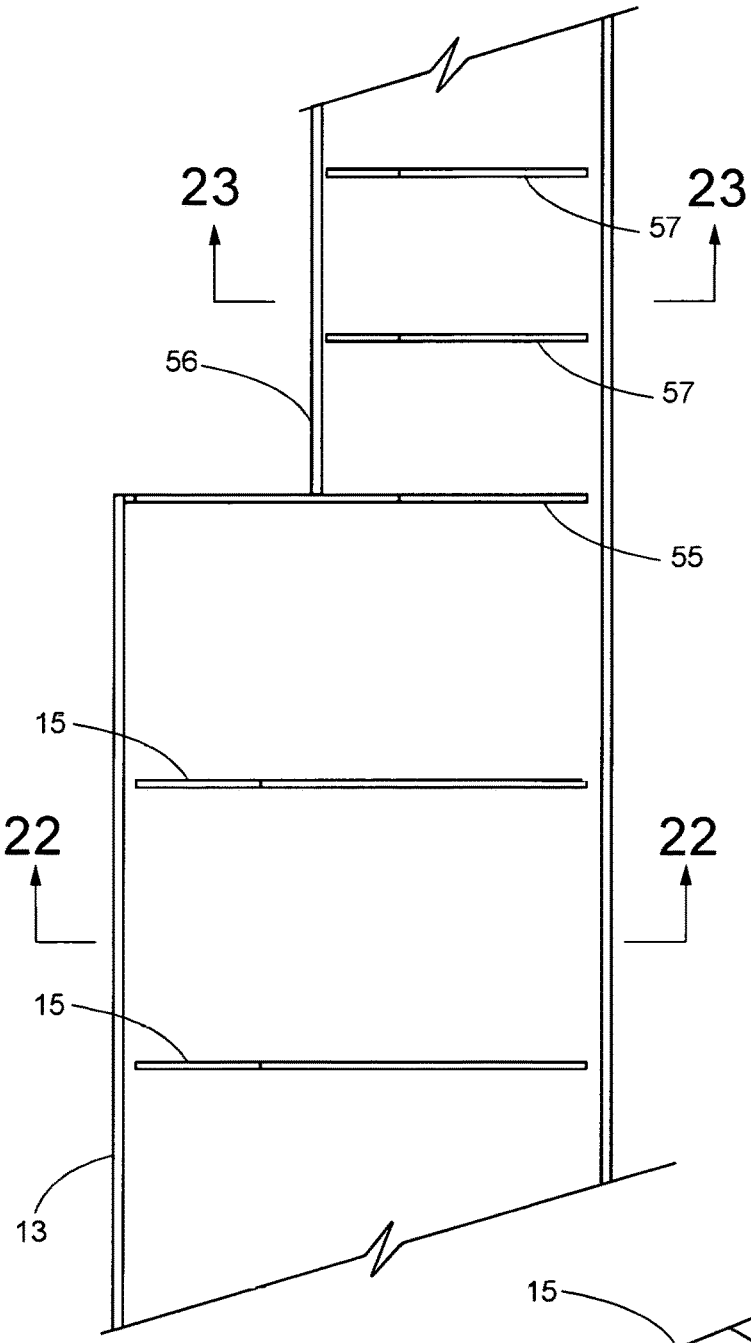
FIG. 21 is a plan view of an alternate processing vessel arrangement which shows the ability of having multiple cross section areas within a single vessel.

FIG. 21 shows a plan view of a vessel arrangement of varying section profiles. Vessel 13, with a profile area of one diameter proceeds to a position where, required by process specifics, a profile area reduction is preferred. At this point a vessel transition dam 55 is provided to transfer the material from vessel 13 to reduced area vessel 56 of a diameter smaller than the diameter of the preceding vessel 13. Beyond this position a reduced vessel dam 57 aligned to the top of the vessel dam 55 maintains a consistent granular material 12 level.

Figure 22:
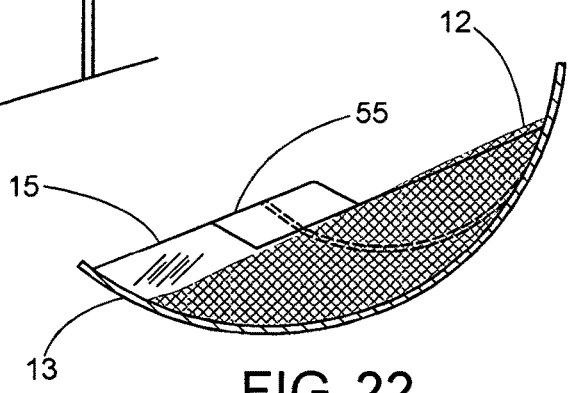
FIG. 22 is a section view of FIG. 21 that shows two joined cross section vessel areas with one of a reduced area.

FIG. 22 shows a cross section of the larger profile area vessel 13, vessel dam 15 and the vessel transition dam 55.

Figure 23:
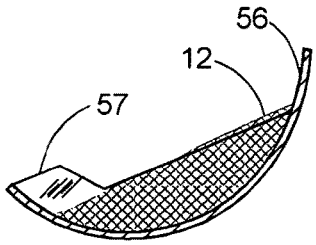
FIG. 23 is a section view of FIG. 21 showing the reduced area vessel section

FIG. 23 shows a cross section of the reduced area vessel 56 and reduced area vessel dam 57.

What is claimed is:

1. A calciner for heating a granular material, the calciner comprising:

a. an elongated vessel having a feed chute proximate a front plate, a discharge chute proximate an end plate, and a longitudinal axis extending from the front plate to the end plate;

b. a plurality of vessel dams substantially equally spaced along the longitudinal axis, each of the plurality of vessel dams having an upper portion and a lower portion, each of the upper portion and the lower portion oriented substantially orthogonal to the longitudinal axis, the upper portion having an upwardly inclined edge, the vessel dams shaped and located such that passage of the granular material from the feed chute to the discharge chute along the longitudinal axis is blocked by the lower portion of the vessel dams and the granular material must traverse each of the vessel dams by passing above the upwardly inclined edge of the upper portion;

c. a platform on which the vessel is mounted;

d. two rotary vibrators attached to the platform and spaced apart along the longitudinal axis, wherein one of the rotary vibrators is configured to have a direction of rotation counter to a direction of rotation of the other of the rotary vibrators, the direction of rotation of each of the rotary vibrators being perpendicular to the longitudinal axis of the vessel; and e. a furnace which surrounds the vessel.

2. A method for moving a granular material through a vessel, the method comprising:

a. providing:

i. an elongated vessel having a feed chute proximate a front plate, a discharge chute proximate an end plate, and a longitudinal axis extending from the front plate to the end plate;

ii. a plurality of vessel dams substantially equally spaced along the longitudinal axis, each of the plurality of vessel dams having an upper portion and a lower portion, each of the upper portion and the lower portion oriented substantially orthogonal to the longitudinal axis, the upper portion having an upwardly inclined edge, the vessel dams shaped and located such that passage of the granular material from the feed chute to the discharge chute along the longitudinal axis is blocked by the lower portion of the vessel dams and the granular material must traverse each of the vessel dams by passing above the upwardly inclined edge of the upper portion;

iii. a platform on which the vessel is mounted; and iv. two rotary vibrators attached to the platform and spaced apart along the longitudinal axis;

b. adding granular material to the vessel through the feed chute;

c. vibrating the vessel by rotating the two rotary vibrators such that one of the rotary vibrators has a direction of rotation counter to a direction of rotation of the other of the rotary vibrators, and the direction of rotation of each of the rotary vibrators is perpendicular to the longitudinal axis of the vessel, thereby causing the granular material to pass through the vessel along the longitudinal axis and traverse the vessel dams; and d. discharging the granular material through the discharge chute.

3. The calciner according to claim 1, further comprising:

a plurality of drain openings in a bottom of the vessel, each of the plurality of drain openings located near one of the plurality of vessel dams;

a plurality of gravity drain ports, each located beneath one of the plurality of drain openings, each of the plurality of gravity drain ports including vertically offset shelves protruding from opposing sidewalls of the gravity drain ports, the shelves partially overlapping in a horizontal direction; and a drain trough located beneath the plurality of gravity drain ports, each of the gravity drain ports opening thereto.

4. The calciner according to claim 1, further comprising:

a vessel cover extending along the vessel between the front plate and the end plate;

the vessel including a first region having a first cross-sectional profile defined by an internal surface of the first region of the vessel and an internal surface of the vessel cover when the vessel cover is in a closed position, and a second region having a second cross-sectional profile defined by an internal surface of the second region of the vessel and an internal surface of the vessel cover when the vessel cover is in a closed position, the first and second cross-sectional profiles each having an orthogonal orientation to the longitudinal axis, wherein the first cross-sectional profile has a first area greater than a second area of the second cross-sectional profile;

a first set of the plurality of vessel dams located in the first region and a second set of the plurality of vessel dams located in the second region; and a vessel transition dam adjoining the first region and the second region, oriented substantially parallel to the plurality of vessel dams, and shaped and positioned such that the granular material passing from the first region to the second region along the longitudinal axis must traverse the vessel transition dam.

5. The calciner according to claim 1, further comprising:

a vessel cover extending along the vessel between the front plate and the end plate;

a cross-sectional profile defined by an internal surface of the vessel and an internal surface of the vessel cover when the vessel cover is in a closed position, the cross-sectional profile having an orthogonal orientation to the longitudinal axis;

the plurality of vessel dams mounted to the internal surface of the vessel, offset from the vessel cover, and having an outer shape smaller than the cross-sectional profile.

6. The calciner according to claim 1, wherein the platform is substantially horizontal and the elongated vessel is inclined upwardly away from the platform in a direction orthogonal to the longitudinal axis.

7. The calciner according to claim 6, wherein the elongated vessel is inclined upwardly at an angle of between 20 degrees and 40 degrees.

* * * * *